US011034046B2

(12) United States Patent
Dries et al.

(10) Patent No.: US 11,034,046 B2
(45) Date of Patent: Jun. 15, 2021

(54) ADJUSTABLE PUNCH HEAD ASSEMBLY

(71) Applicant: Amada Tool America, Inc., Batavia, NY (US)

(72) Inventors: Edward A. Dries, Le Roy, NY (US); Jeffrey Tauscher, Basom, NY (US)

(73) Assignee: Amada Tool America, Inc., Batavia, NY (US)

( * ) Notice: Subject to any disclaimer, the term of this patent is extended or adjusted under 35 U.S.C. 154(b) by 110 days.

(21) Appl. No.: 15/479,028

(22) Filed: Apr. 4, 2017

(65) Prior Publication Data

US 2018/0281223 A1 Oct. 4, 2018

(51) Int. Cl.
*B26F 1/14* (2006.01)
*B21D 28/34* (2006.01)

(52) U.S. Cl.
CPC ..... *B26F 1/14* (2013.01); *B21D 28/346* (2013.01); *Y10T 83/9428* (2015.04); *Y10T 83/9476* (2015.04); *Y10T 83/9486* (2015.04)

(58) Field of Classification Search
CPC ..... B21D 28/346; B21D 28/34; B26F 1/14; B30B 15/026; Y10T 83/9423; Y10T 83/9428; Y10T 83/9476; Y10T 83/9483; Y10T 83/9486
USPC ..... 83/698.91, 699.31, 699.41, 684, 686
See application file for complete search history.

(56) References Cited

U.S. PATENT DOCUMENTS 1,809,553 A * 6/1931 Graul ..... B21D 28/34 279/89
1,809,823 A * 6/1931 Altvater ..... B21D 28/34 279/97
4,604,931 A * 8/1986 Bastian ..... B26F 1/14 279/76
6,047,621 A 4/2000 Dries et al.
6,142,052 A 11/2000 Endo
6,276,247 B1 8/2001 Heida
6,463,839 B2 * 10/2002 Ohtsuka et al. ..... B21D 19/08 83/686
7,156,009 B2 1/2007 Iwamoto et al.
7,168,356 B2 1/2007 Rosene et al.
7,204,181 B2 * 4/2007 Goedeking ..... B21D 28/34 234/114

(Continued)

FOREIGN PATENT DOCUMENTS

JP 2001105053 A 4/2001
JP 2004141922 A 5/2004

*Primary Examiner* — Clark F Dexter
(74) *Attorney, Agent, or Firm* — Blank Rome LLP

(57) ABSTRACT

A punch head assembly that includes a punch head including a main body having opposite first and second ends, a longitudinal inner bore, a first passageway extending substantially radially from the inner bore, and a second passageway substantially traversing the first passageway. A ball bearing is received in the first passageway. A pin member is received in the second passageway. The pin member is rotationally movable between first and second positions. A driver is coupled to the punch head and includes a stem extending into the inner bore. The stem has an outer ball engagement surface. The punch head is axially movable with respect to the stem. Axial movement of the pin member in the second passageway moves the ball bearing into and out of engagement with the outer ball engagement surface for adjusting an axial position of the punch head with respect to the driver.

15 Claims, 2 Drawing Sheets

(56) References Cited

U.S. PATENT DOCUMENTS

| | | | |
|---|---|---|---|
| 7,658,134 | B2 | 2/2010 | Morgan |
| 7,954,404 | B2 | 6/2011 | Thielges et al. |
| 8,408,111 | B2 | 4/2013 | Johnston et al. |
| 8,714,065 | B2 | 5/2014 | Takahashi et al. |

* cited by examiner

ADJUSTABLE PUNCH HEAD ASSEMBLY

FIELD OF THE INVENTION

The present invention relates to a punch head assembly for a punching tool. More specifically, the present invention relates to a punch head assembly that is adjustable, thereby allowing adjustment of the length of the punching tool.

BACKGROUND OF THE INVENTION

Punching tools are typically used for creating different sizes and shapes of indentations or cuts in a workpiece, such as sheet metal. Punching tools often wear down from use, however, and thus either re-machining or replacement of the tool is required.

A need exists for a punch head assembly for a punching tool that is adjustable to allow easy in-field adjustment of the length of the punching tool, thereby avoiding re-machining or replacement of the tool.

SUMMARY OF THE INVENTION

Accordingly, the present invention may provide a punch head assembly that comprises a punch head that includes a main body that has opposite first and second ends, and a longitudinal inner bore that extends between the first and second ends. The main body has at least one first passageway that extends substantially radially from the inner bore, and at least one second passageway substantially traversing the first passageway. A ball bearing is receivable in the first passageway. A pin member is receivable in the second passageway for engaging the ball bearing. The pin member is rotationally movable between first and second positions with respect to a longitudinal axis of the second passageway. A driver is coupled to the punch head. The driver includes a stem extending through the second end of the punch head and into the inner bore. At least a portion of the stem has an outer ball engagement surface. The punch head is axially movable with respect to the stem of the driver. Axial movement of the pin member in the second passageway moves the ball bearing into and out of engagement with the outer ball engagement surface of the driver for adjusting an axial position of the punch head with respect to the driver.

The present invention may also provide a punch head assembly that comprises a punch head that includes a main body that has opposite first and second ends, and a longitudinal inner bore extending between the first and second ends. A driver is coupled to the punch head. The driver has a base and a stem that extends from the base. The stem extends into the inner bore of the punch head. The punch head is axially movable with respect to the driver. Means for adjusting an axial position of the punch head with respect to the stem of the driver is provided.

The present invention may yet further provide a method of adjusting a punch head assembly that has a punch head coupled to a driver and the punch head has a ball bearing received in a first passageway and a pin member received in a second passageway, comprising the steps of pushing the pin member into the second passageway to move the ball bearing from a ball securing portion of a working channel of the pin member to a ball receiving portion of the working channel; adjusting the punch head axially with respect to the driver to establish an axial position of the punch head; and releasing the pin member to force the ball bearing into the ball receiving portion of the working channel such that ball bearing engages the driver, thereby locking the axial position of the punch head.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing figures.

DETAILED DESCRIPTION OF THE INVENTION

Referring to FIGS. 1-6, the present invention relates to a punch head assembly 100 for a punching tool 10 that is designed to allow easy in-field adjustment of the length of the punching tool 10 as the tool wears down. The punch head assembly 100 according to an exemplary embodiment of the present invention generally includes a punch head 102 coupled to a driver 104 and an adjustment mechanism for adjusting the axial position of the punch head 102, that is the distance between punch head 102 and driver 104. That adjustment in the axial position of punch head 102 provides for adjustment in the length of the punching tool 10.

Figure 1:
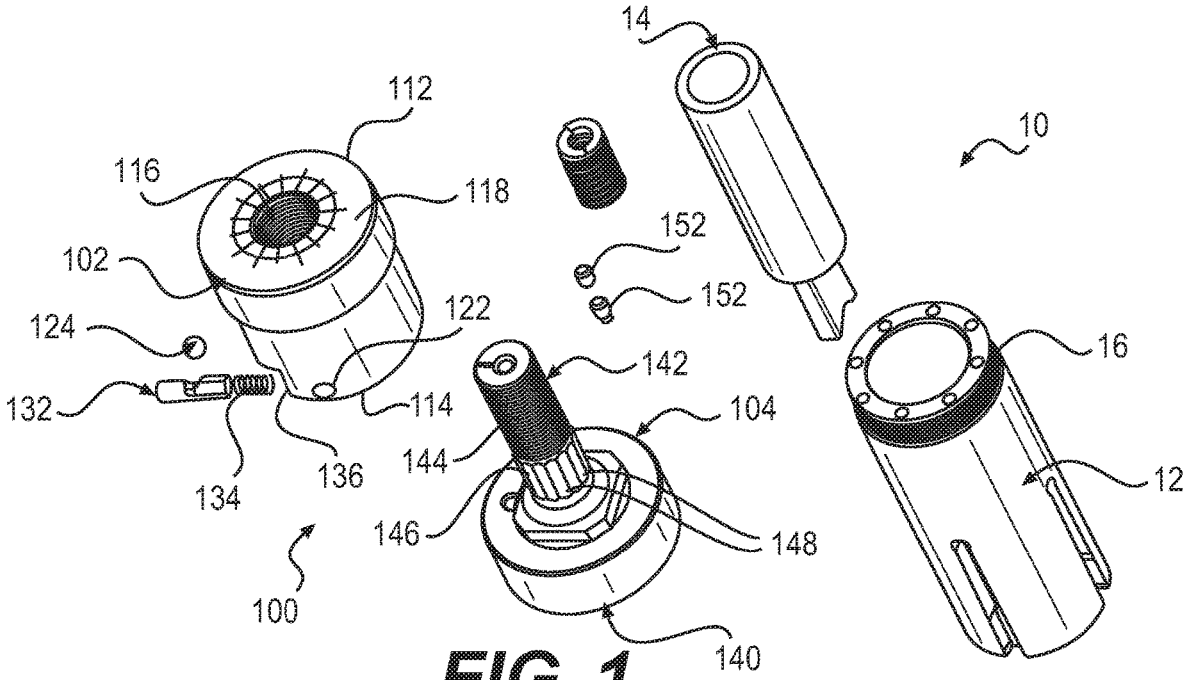
FIG. 1 is an exploded perspective view of a punch head assembly according to an exemplary embodiment of the present invention, showing the punch head assembly with components of a punching tool.
Figure 2:
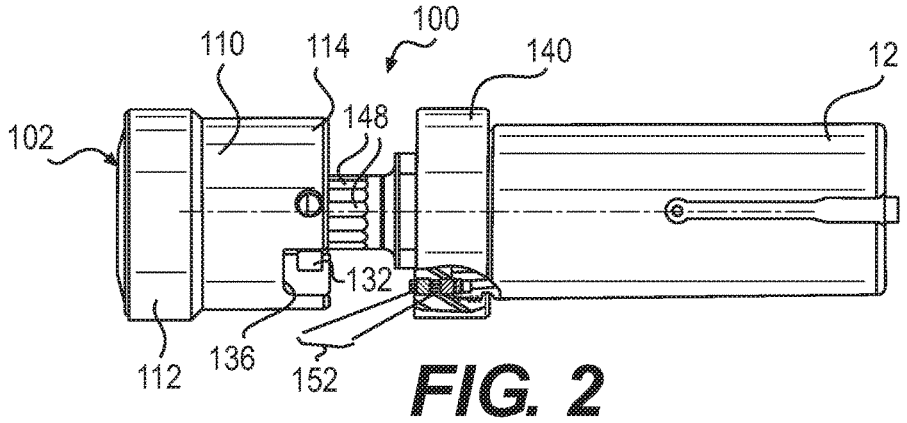
FIG. 2 is side elevational view of the punch head assembly illustrated in FIG. 1; showing the punch head assembly coupled to the components of the punching tool.
Figure 3:
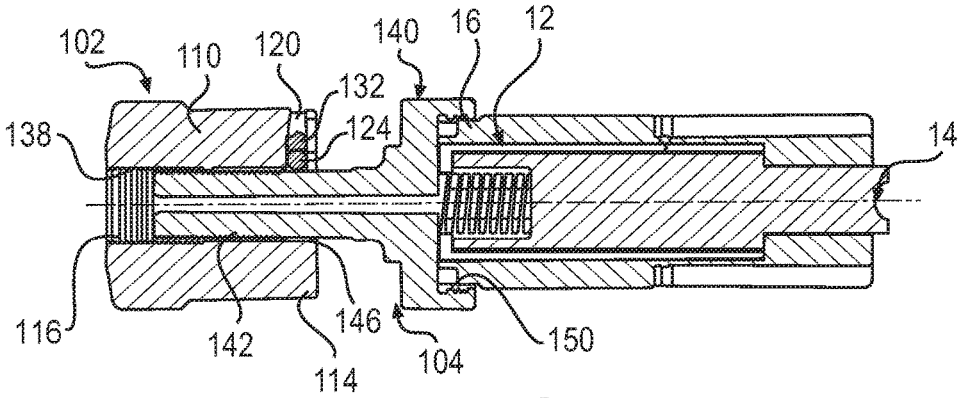
FIG. 3 is cross-sectional view of FIG. 2.

As seen in FIGS. 1-3, punch head assembly 100 may be coupled to a punch body 12 of the punching tool 10. Punch body 12 provides a cutting function and may optionally include a spring loaded ejecting member 14 loaded by spring 14*a* therein, which functions to form and eject the part from punch body 12, as is well known in the art.

Punch head 102 generally includes a main body 110 with opposite first and second ends 112 and 114 and a longitudinal inner bore 116 extending between first and second ends 112 and 114. Inner bore 116 is preferably sized and configured to receive a portion of driver 104. An end face 118 at first end 112 preferably includes indicia 118*a*, such as an etched scale, that provides the operator a gauge for how much the tool 10 is being adjusted.

Figure 5:
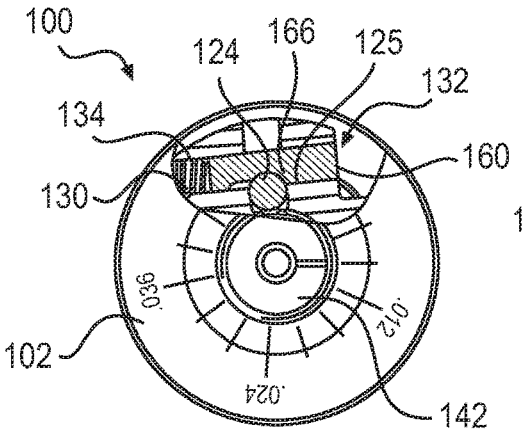
FIG. 5 is a top plan view with a partial cut away of the punch head assembly illustrated in FIG. 1, showing the pin member and associated ball bearing in a disengaged position.
Figure 6:
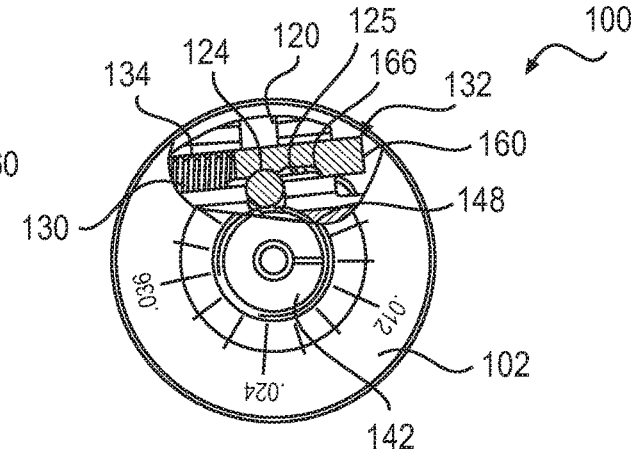
FIG. 6 is similar to FIG. 5, except it shows the pin member and ball bearing in an engaged position.

Main body 110 includes a ball bearing passageway 120 that extends substantially radially outward from inner bore 116. Passageway 120 is open at its outer end 122 to allow insertion of a ball bearing 124 and open at its inner end 125 to allow engagement of ball bearing 124 with driver 104, as best seen in FIGS. 5 and 6. Inner end 125 is preferably sized to trap the ball bearing 124, thereby preventing the ball bearing 124 from falling through the passageway 120. Main body 110 also includes a pin passageway 130 that substantially traverses ball bearing passageway 120 to essentially divide the same. Pin passageway 130 is sized and configured to slidably receive a pin member 132 that is spring loaded by spring 134, as best seen in FIGS. 5 and 6. Pin passageway 130 extends in a direction that is substantially transverse to the longitudinal inner bore 116, as best seen in FIGS. 1 and 3. Both passageways 120 and 130 are preferably located at or near the second end 114 of main body 110. A cutout portion 136 may be provided in main body 110 at second end 114 that is sized to allow access to pin passageway 130 by pin member 132.

Drive 104 includes a base 140 and a stem 142 extending from base 140. Stem 142 is insertable into the inner bore 116 of punch head 102 through its second end 114. Punch head 102 is axially movable with respect to stem 142 of driver 104. In a preferred embodiment, stem 142 and inner bore 116 are threadably engaged. That is, inner bore 116 of punch head 102 may include inner threads 138 that engage outer threads 144 on a portion of stem 142. This threaded engagement allows punch head 102 to rotate and move axially with respect to the driver's stem 142 to adjust the axial position of punch head 102. Stem 142 may also include an outer ball engagement surface 146, preferably adjacent to outer threads 144, that cooperates with ball bearing 124 to lock the selected axial position of punch head 102 with respect to driver 104. Outer ball engagement surface 146 may include, for example, one or more slots 148 sized to receive a portion of ball bearing 124, as seen in FIG. 5. Slots 148 are preferably longitudinally arranged on and extend around the outer surface of stem 142. In a preferred embodiment, slots 148 extend continuously around the stem 142.

Base 140 of driver 104 couples to punch body 12 of the punching tool 10. Base 140 may include an inner recessed area 150 sized to receive an end 16 of punch body 12, as best seen in FIG. 3. In a preferred embodiment, the end 16 of punch body 12 has threads 16*a* that engage corresponding threads 150*a* of the driver's inner recessed area 150. Fasteners 152, such as set screws, as seen in FIG. 2, may also be used to attach the driver's base 140 to the end 16 of punch body 12 and prevent any relative movement between driver 104 and punch body 12.

Figure 4A:
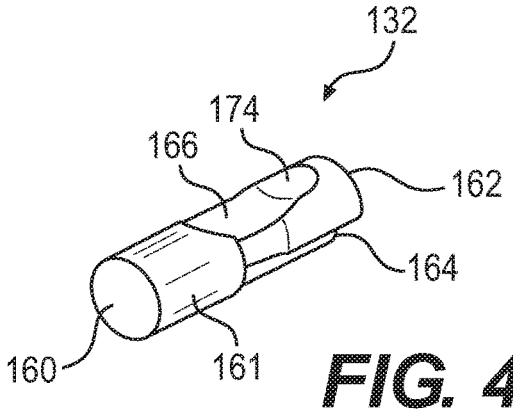
FIGS. 4*a*-4*d* are various views of a pin member of the punch head assembly illustrated in FIG. 1.
Figure 4B:
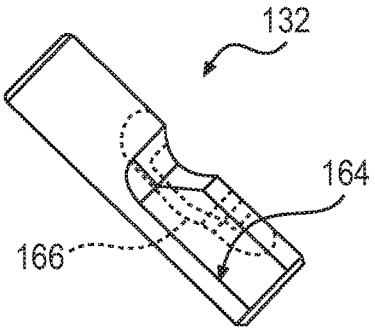
Figure 4C:
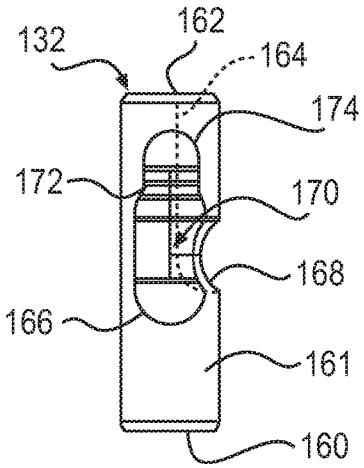
Figure 4D:
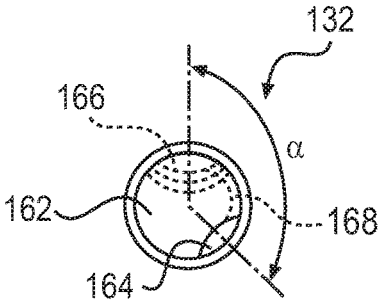

Pin member 132 is shaped and configured to move ball bearing 124 in and out of engagement with one of slots 148 on stem 142 of driver 104 when pin member 132 is moved in pin passageway 130. As seen in FIGS. 4*a*-4*d*, pin member 132 generally includes a proximal end 160, a distal end 162, an installation channel 164, a working channel 166 spaced from installation channel 164, and a linking channel 168 that joins installation and working channels 164 and 166. Distal end 162 is inserted into ball passageway 120 of punch head 102 and proximal end 160 provides a grasping section 161 that allows manipulation of pin member 132 by the operator. Installation and working channels 164 and 166 are preferably spaced from one another by a certain number of degrees $\alpha$, preferably about 90 to 180 degrees, and more preferably about 135 degrees, as seen in FIG. 4*d*.

Installation channel 164 is open at distal end 162 and may extend to about the middle of pin member 132. Installation channel 164 is sized to at least partially receive ball bearing 124, thereby allowing pin member 132 to slide into pin passageway 130 past or alongside of ball bearing 124. Working channel 166 is shaped to receive ball bearing 124 and move the same into engagement with stem 142 of driver 104. Working channel 166 is not open at either the proximal or distal ends 160 and 162. Working channel 166 includes a ball receiving portion 170, a ball securing portion 172, and a stepped portion 174 therebetween, as best seen in FIG. 4*c*. Ball receiving portion 170 receives ball bearing 124 from linking channel 168 when pin member 132 is rotated to move ball bearing 124 out of installation channel 164 and into working channel 166. Stepped portion 174 guides ball bearing 124 into ball securing portion 172. Ball securing portion 172 secures ball bearing 124 into engagement with slots 148 on the driver's stem 142.

Punch head assembly 100 is assembled by initially assembling the ball bearing 124, spring 134, and pin member 132 with punch head 102. First, ball bearing 124 is inserted into ball bearing passageway 120 in punch head 102 and to the inner end 125 of passageway 120 such that ball bearing 124 rests at inner end 125; next spring 134 may be inserted into pin passageway 130; and then pin member 132 may be inserted into pin passageway 130 against the bias of spring 134 with its installation channel 164 facing inward in the direction of ball bearing 124, thereby allowing pin member 132 to slide axially in pin passageway 130 past or alongside of ball bearing 124, as best seen in FIG. 5. As seen in FIGS. 5 and 6, pin passageway 130 extends in a direction that is substantially transverse to the punch head's longitudinal inner bore, which receives the stem 142. That is, the longitudinal axis defined by the pin passageway 130 extends in a direction that is substantially transverse to the longitudinal axis defined by the inner bore 116.

Once pin member 132 is inserted into passageway 130, pin member 132 may be rotated a certain number of degrees, for example 135 degrees, about a longitudinal axis of pin passageway 130 until ball bearing 124 reaches working channel 166. More specifically, rotation of pin member 132 forces ball bearing 124 into linking channel 168 which extends ball bearing 124 to ball receiving portion 170 of working channel 166. When pin member 132 is released, the spring 134 pushes pin member 132 in a direction out of the passageway 130 so that stepped portion 174 guides ball bearing 124 into ball securing portion 172 of working channel 166 with a portion of the ball bearing 124 extending into the punch head's inner bore 116 at the inner end 125 of passageway 120. Pin member 132 is retained in punch head 102 because ball bearing 124 prevents pin member 132 from coming out of pin passageway 130.

Once the ball bearing 124, spring 134, and pin member 132 are assembled with punch head 102, the pre-assembled punch head 102 may be coupled with driver 104. To do so, pin member 132 is pushed in against spring 134 to move ball bearing 124 to the ball receiving portion 170 of working channel 166, thereby allowing unobstructed insertion of stem 142 of driver 104 into inner bore 116 of punch head 102. Once the stem 142 is inserted into punch head 102, at least a portion 138 of the inner surface of inner bore 116 and at least a portion 144 of the outer surface of stem 142 are preferably threadably engaged. Pin member 132 may then be released to move the ball bearing 124 back into ball securing portion 172 of working channel 166 such that the ball bearing 124 engages outer ball engagement surface 146 of stem 142, preferably by engaging one of the slots 148.

The engagement between ball bearing 124 and one of the slots 148 stops rotation and axial movement of punch head 102 with respect to the driver's stem 142 to lock punch head 102 in a selected axial position. Spring 134 pushes against distal end 162 of pin member 132 to force pin member 132 out of pin passageway 130. That leaves grasping section 161 of pin member 132 exposed for manipulation by the operator, as seen in FIG. 6.

To adjust the axial position of punch head 102 with respect to driver 104, pin member 132 can be pushed into pin passageway 130 until ball bearing 124 is disposed in ball receiving portion 170 of working channel 168. Because ball receiving portion 170 is deeper than ball securing portion 172 in channel 166, pushing pin member 132 toward the back of passageway 130 releases ball bearing 124 from engagement with stem 142 and allows ball bearing 124 to move out of ball securing portion 172 and rest in ball receiving portion 170. Punch head 102 can then be moved axially with respect to driver 104, such as by rotating punch head 102 via the threads 138, 144, for example, to adjust its axial position. Once the new axial position of punch head 102 is selected, it can be locked in place by releasing pin member 132 in the same manner as described above, allowing ball bearing 124 to fall into slot 148.

While a particular embodiment has been chosen to illustrate the invention, it will be understood by those skilled in the art that various changes and modifications can be made therein without departing from the scope of the invention as defined in the appended claims.

What is claimed is:

1. A punch head assembly, comprising:

a punch head including a main body having opposite first and second ends, and a longitudinal inner bore extending between said first and second ends, said main body having at least one first passageway extending substantially radially from said inner bore, and at least one second passageway substantially traversing a respective one of said at least one first passageway and extending in a direction that is substantially transverse to a longitudinal axis of the longitudinal inner bore;

a ball bearing received in one of said at least one first passageway;

a pin member received in the respective of said at least one second passageway, said pin member having a working channel configured to engage said ball bearing, said pin member being movable between first and second positions with respect to a longitudinal axis of the respective second passageway; and a driver coupled to said punch head, said driver including a stem extending through said second end of said punch head and into said inner bore, at least a portion of said stem having an outer ball engagement surface, said punch head being axially movable with respect to said stem of said driver, wherein axial movement of said pin member in the respective second passageway moves said ball bearing into and out of engagement with said outer ball engagement surface of said driver for adjusting an axial position of said punch head with respect to said driver, and wherein said working channel includes a ball securing portion that receives said ball bearing for securing said ball bearing into engagement with said outer ball engagement surface of said driver and locking the axial position of said punch head, and said working channel includes a ball receiving portion that receives said ball bearing for allowing said ball bearing to move out of engagement with said ball engagement surface of said driver and for guiding said ball bearing into said ball securing portion.

2. A punch head assembly according to claim 1, wherein at least a portion of said inner bore has inner threads; and at least a portion of said stem has outer threads engaging said inner threads of said inner bore of said punch head.

3. A punch head assembly according to claim 1, wherein said pin member has a distal end and a proximal end, and includes an installation channel that is open at said distal end and sized to slidably receive at least a portion of said ball bearing when said pin member is in said first position in the respective second passageway.

4. A punch head assembly according to claim 1, wherein said working channel is spaced from said installation channel, an end of said working channel includes the ball securing portion.

5. A punch head assembly according to claim 4, wherein said working channel includes a stepped portion between said ball receiving portion and said ball securing portion for guiding said ball bearing into said ball securing portion.

6. A punch head assembly according to claim 4, wherein said pin member includes a linking channel that connects said installation and working channels, said ball bearing moves through said linking channel when said pin member is moved between said first and second positions.

7. A punch head assembly according to claim 1, further comprising a spring received in said second passageway that abuts said distal end of said pin member, thereby biasing said pin member out of the respective second passageway.

8. A punch head assembly according to claim 1, wherein the respective first and second passageways are located at or near said second end of said main body of said punch head.

9. A punch head assembly according to claim 1, wherein said second end of said main body includes an access cutout that provides access to said pin member received in the respective second passageway.

10. A punch head assembly according to claim 1, wherein said outer ball engagement surface of said driver includes one or more slots longitudinally arranged on said stem.

11. A punch head assembly according to claim 10, wherein said driver includes a base from which said stem extends and axial movement of said pin member allows adjustment of an axial distance between said punch head and said base of said driver.

12. A punch head assembly according to claim 11, wherein said base is configured to couple to a punch body.

13. A punch head assembly, comprising:

a punch head including a main body having opposite first and second ends, and a longitudinal inner bore extending between said first and second ends, said main body having at least one first passageway extending substantially radially from said inner bore, and at least one second passageway substantially traversing a respective one of said at least one first passageway and extending in a direction that is substantially transverse to a longitudinal axis of said longitudinal inner bore;

a ball bearing received in one of said at least one first passageway;

a pin member received in the respective one of said at least one second passageway, said pin member having a working channel configured to engage said ball bearing, said pin member being rotationally movable between first and second positions with respect to a longitudinal axis of the respective second passageway; and a driver coupled to said punch head, said driver including a stem extending through said second end of said punch head and into said inner bore, at least a portion of said stem having an outer ball engagement surface, said punch head being axially movable with respect to said stem of said driver, wherein axial movement of said pin member in the respective second passageway moves said ball bearing into and out of engagement with said outer ball engagement surface of said driver for adjusting an axial position of said punch head with respect to said driver, and wherein said working channel includes a ball securing portion that receives said ball bearing for securing said ball bearing into engagement with said outer ball engagement surface of said driver and locking the axial position of said punch head, and said working channel includes a ball receiving portion that receives said ball bearing for allowing said ball bearing to move out of engagement with said ball engagement surface of said driver and for guiding said ball bearing into said ball securing portion.

14. A punch head assembly according to claim 13, wherein at least a portion of said inner bore has inner threads; and at least a portion of said stem has outer threads engaging said inner threads of said inner bore of said punch head.

15. A punch head assembly according to claim 13, further comprising a spring located in the respective second passageway, said spring abutting said pin member for biasing said pin member out of the respective second passageway.

* * * * *